US005888253A

United States Patent [19]

Yamamoto et al.

[11] Patent Number: 5,888,253

[45] **Date of Patent: *Mar. 30, 1999**

[54] TEXTILE-PRINTING METHOD, PRINTED TEXTILE OBTAINED THEREBY, AND INK

[75] Inventors: Tomoya Yamamoto, Kawasaki; Masahiro Haruta, Tokyo; Shoji Koike, Yokohama; Koromo Shirota, Kawasaki; Aya Yoshihira, Yokohama; Mariko Suzuki, Kawasaki, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 910,720

[22] Filed: Aug. 13, 1997

Related U.S. Application Data

[63] Continuation of Ser. No. 502,347, Jul. 14, 1995, abandoned.

[30] Foreign Application Priority Data

Jul. 21, 1994 [JP] Japan ..... 6-169436

[51] Int. Cl.[6] ..... D06P 3/36; C09D 11/00; B41J 2/04

[52] U.S. Cl. ..... 8/466; 8/445; 8/499; 8/662; 8/675; 8/922; 106/31.27; 106/31.51; 106/31.57

[58] Field of Search ..... 8/445, 499, 466, 8/922; 106/31.27, 31.51, 31.57; 347/100

[56] References Cited

U.S. PATENT DOCUMENTS

| | | | |
|---|---|---|---|
| 4,131,424 | 12/1978 | Cocoros et al. | 8/172 R |
| 4,334,878 | 6/1982 | Cutler et al. | 524/88 |
| 4,702,742 | 10/1987 | Iwata et al. | 8/495 |
| 4,725,849 | 2/1988 | Koike et al. | 346/1.1 |
| 4,849,770 | 7/1989 | Koike et al. | 346/1.1 |
| 4,969,951 | 11/1990 | Koike et al. | 106/22 |
| 5,160,348 | 11/1992 | Hoppe et al. | 8/639 |
| 5,382,561 | 1/1995 | Mori et al. | 503/222 |

FOREIGN PATENT DOCUMENTS

| | | |
|---|---|---|
| 54-059936 | 5/1979 | Japan . |
| 61-118477 | 6/1986 | Japan . |

*Primary Examiner*—Margaret Einsmann
*Attorney, Agent, or Firm*—Fitzpatrick, Cella, Harper & Scinto

[57] ABSTRACT

A textile-printing method imparts ink containing a cyan disperse dye and ink containing blue disperse dye on a cloth such that the cyan ink and the blue ink are at least partially overlapped, thereby forming a color mixture portion on the cloth, wherein a weight ratio of the cyan dye to the blue dye at the overlapped portion is specified in the range of from 10:1 to 100:1.

27 Claims, 6 Drawing Sheets

TEXTILE-PRINTING METHOD, PRINTED TEXTILE OBTAINED THEREBY, AND INK

This application is a continuation of application Ser. No. 08/502,347 filed Jul. 14, 1995, now abandoned.

BACKGROUND OF THE INVENTION

1. Field of the Invention

The present invention relates to a textile-printing method using an ink jet method, a printed textile obtained using the method, and ink for ink jet textile-printing.

2. Related Art

The most common techniques for textile-printing, at present, are screen printing and roller printing. These printing systems, however, are unsuitable for fabrication of multiple products in small amounts, and cause difficulties for those trying to keep up with changes in fashion. For this reason, in recent years, it has been required to establish an electronic textile-printing system which do not involve platemaking.

To meet the requirement, a variety of textile-printing methods using ink jet recording have been proposed, and have come to be greatly expected in various industrial fields.

Requirements for ink jet textile-printing include:

(1) providing a sufficient density for color development;

(2) achieving a high color yield of a dye on a cloth, and ease in waste water treatment following the washing process;

(3) suppressing irregular bleeding due to mixture of different colors on a cloth;

(4) allowing a wide range of color reproduction; and (5) offering a printed textile excellent in color development.

To satisfy these requirements, various methods have been proposed, for example, of including various additives in the ink, adjusting the jetted amount of ink, pre-treating the cloth, and the like. A method of performing textile-printing on a polyester cloth has been disclosed in Unexamined Japanese Patent Publication No. SHO 61-118477, wherein a disperse dye having a sublimation temperature of 180° C. or more is used for ink jet. With respect to this method, the present inventors have studied to dye the cloth with ink containing a disperse dye selected in terms of only its sublimation temperature, and found that when each ink is singly dyed on the cloth, an excellent color development can be obtained; however, when ink of one color is mixed with ink of a different color on the cloth, the density and the color tone after dyeing and the color reproducibility upon dyeing under the same condition are significantly varied depending on the combination of the dyes used, and most cases, the above-described requirements (1), (4) and (5) cannot be simultaneously satisfied, and consequently, the above-described method is inadequate for allowing the expression of various colors. Accordingly, it is difficult to fully satisfy the above-described requirements, particularly, the requirement (5) using conventional methods.

In particular, a disperse dye has a limitation in the molecular structure of the dye on the basis of the dyeing mechanism of the dye, and thereby it presents a problem that a high density of cyan functioning as the basis of subtractive color mixture is difficult to be obtained.

SUMMARY OF THE INVENTION

An object of the present invention is to solve the above-described problems of the conventional ink jet textile-printing which are caused upon ink jet textile-printing on a cloth mainly made of fibers capable of being dyed by a disperse dye, and to provide a textile-printing method capable of obtaining a printed textile having a high density and clear cyan color and of obtaining a stable image not changeable in color tone even when a dyeing treatment condition by heating is somewhat varied, a printed textile obtained by the method, and ink used for the method.

Another object of the present invention is to provide a textile-printing method capable of obtaining an excellent cyan color, thereby significantly allowing a wide range of the color reproduction in green expression obtained by color mixture with yellow ink.

To achieve the above object, according to a preferred mode of the present invention, there is provided a method of printing on a cloth containing fibers employing a disperse dye by an ink jet system using a cyan ink and a blue ink respectively containing at least disperse dyes of cyan and blue, comprising the step of:

(a) imparting the cyan ink and the blue ink on the cloth so that the cyan ink and the blue ink are at least partially overlapped, (b) heat-treating the cloth imparted with the cyan ink and the blue ink; and (c) washing the heat-treated cloth, wherein a weight ratio of the cyan dye to the blue dye at the overlapped portion is specified in the range of from 10:1 to 100:1.

According to another preferred mode of the present invention, there is provided ink for ink jet textile-printing containing at least disperse dyes of cyan and blue and aqueous media, wherein a weight ratio of the cyan dye to the blue dye is specified in the range of 10:1 to 100:1.

DETAILED DESCRIPTION OF THE PREFERRED EMBODIMENTS

Figure 1:
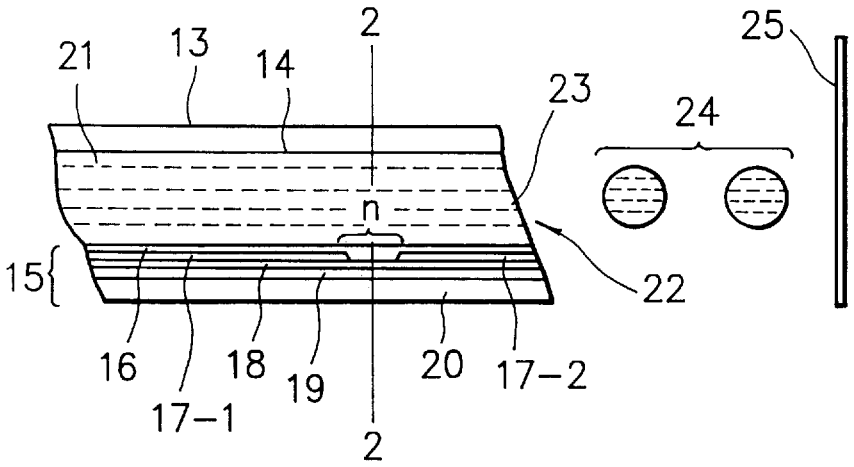
FIG. 1 is a side cross-sectional view of a head portion of an ink jet recording apparatus.

The present inventors have examined the ink jet textile-printing capable of satisfying all of the above-described requirements in performance, and found that in the case of ink jet textile-printing using ink containing a disperse dye, the above-described requirements can be satisfied by ejecting a blue dye to a cyan dye portion in a ratio of from 10:1 to 100:1 (cyan dye to blue dye).

As a disperse dye having a cyan color, a dye containing anthraquinone as a color development base is preferable in terms of hue and light resistance. Such a disperse dye for cyan color, however, has a limitation in the molecular structure of the dye on the basis of the dyeing mechanism of the dye and is thus difficult to obtain a high density. The present inventors have found that a high density of cyan color can be obtained by ejecting a dye having a blue color to the cyan dye portion at a ratio of from 10:1 to 100:1 (cyan dye to blue dye); a green color having a high density and a high saturation can be obtained by mixture of the above color-mixed cyan portion with yellow ink; and the build-up performance is improved, and further a large difference in color development is not generated even when the fixing condition such as a treatment temperature and treatment time is somewhat varied upon color development, thus obtaining a stable printed textile.

In the ink jet textile-printing, the viscosity of ink is much lower than that in the conventional textile-printing, for example the screen textile-printing, and thereby the amount of a dye adhered onto a cloth is generally small in consideration of overflow of ink. Moreover, in the ink jet textile-printing, since infinite color tones are expressed by changing the jetted ratio in dots between several kinds of ink, the jetting order of ink and a variation in the cloth exert a large effect on the color development.

Of the effects of the present invention, the build-up performance, which has been regarded as a large subject of the ink jet system, is enhanced because each disperse dye is independent in the dyeing amount, and thereby the dyeing amount is increased using a plurality of the dyes.

Moreover, it is revealed that in terms of the stability in color development, as the kinds of dyes in a color-mixed portion are increased, the effects of the jetting order of ink and of the distribution state of dyes on a cloth exerted on the stability in color development are lowered. Consequently, it becomes important to mix a plurality of dyes at a specified ratio in place of using a single dye.

Next, the present invention will be more fully described with reference to preferred embodiments.

First, a cloth used in the present invention will be described.

A material of a cloth used in the present invention contains fibers capable of being dyed with a disperse dye, and it preferably contains fibers of polyester, acetate or triacetate. In particular, fibers of polyester are most preferable. The above fibers may be used in either of the forms of woven fabric, knit fabric, and unwoven fabric.

The cloth is preferably composed of 100% of fibers capable of being dyed with a disperse dye. However, the cloth for textile-printing of the present invention may include a blended woven fabric or unwoven fabric of fibers capable of being dyed with a disperse dye blended with a different material such as rayon, cotton, polyurethane, polyacrylate, nylon, sheep wool, or silk in a blending ratio of 30% or more, preferably, 50% or more.

The thickness of a yarn constituting such a cloth is preferably in the range of 10 to 100 denier. The thickness of a fiber constituting the yarn is not particularly limited; however, when the thickness of the fiber is one denier or less, the effect of the present invention can be preferably achieved.

The above-described cloth for ink jet textile-printing preferably contains at least one kind selected from a group consisting of a water-soluble metal salt, water-soluble polymer, urea, thiourea and surface-active agent in an amount of 0.01 to 20 wt % on the basis of the total dry weight of the cloth. The total content of these materials is preferably in the range of from 0.5 to 18 wt %, more preferably, in the range of from 1 to 15 wt %. When it is 0.01 wt % or less, the additional effect cannot be achieved; while when it exceeds 20 wt %, in some cases, an inconvenience is likely to occur in terms of feeding performance of the cloth.

The water-soluble polymers are classified into natural polymers and synthetic polymers. Specific examples of the natural water-soluble polymers include starch materials such as corn and wheat; cellulose series materials such as carboxymethylcellulose, methylcellulose, and hydroxyethylcellulose; polysaccharide materials such as sodium alginate, gum arabic, low kasoite bean gum, tragacanth gum, guaiac gum, tamarind seed; protein materials such as gelatin and casein; tannin materials; and lignin materials. Specific examples of the synthetic water-soluble polymers include polyvinylalcohol compounds, polyethylene oxide compounds, acrylic acid series water-soluble polymers, and maleic anhydride series water-soluble polymers. Of these polymers, the polysaccharide materials and cellulose series polymers are preferably used.

The water-soluble metal salts include compounds forming typical ion crystals and having pH of from 4 to 10, for example, halides of alkali metals and alkali earth metals. Specific examples of the alkali metal salts include NaCl, $Na_2SO_4$, KCl, and $CH_3COONa$. Specific examples of the alkali earth metal salts include $CaCl_2$ and $MgCl_2$. In these metals salts, the salts of Na, K and Ca are preferably used.

The surface-active agents are classified into anion, cation, amphoteric, and nonionic types. Specific examples of the anion type include higher alcohol sulfates, sulfonates of naphthalene derivatives; specific examples of the cation type include quaternary ammonium salts; specific examples of the amphoteric type include imidazoline derivatives; and specific examples of the nonionic type include polyoxyethylene alkylether, polyoxyethylene-polyoxypropylene block polymer, sorbitan fatty acid ester, polyoxyethylene sorbitan fatty acid ester, and acethylenealcohol added with ethylene oxide.

Next, the moisture regain of a cloth of the present invention is specified to be preferably in the range of 1.0 to 101.0%, more preferably, in the range of from 3.0 to 81.0%. When it is less than 1.0%, an inconvenience may occur in terms of color development and bleeding-proof; while when it exceeds 101.0%, an inconvenience sometimes is likely to occur in terms of feeding performance and bleeding-proof.

In addition, the moisture regain of a cloth is measured in accordance with JIS-L-1019. Specifically, a sample of 100 g is accurately measured, and is put in a drier at a temperature of 105°±2° C. In this drier, the sample is dried until the weight thereof becomes constant. After that, the sample is washed with water and dried again until the weight thereof becomes constant, and the weight of only the fiber portion after drying is measured. On the basis of the measured results, the moisture regain is calculated by the following equation.

$$\text{Moisture Regain } (\%)=\{(W-W')/W''\}\times 100$$

where W is a weight before drying, W' is a weight after drying, and W" is a weight of fiber portion after water washing and drying.

Ink used for the textile-printing method of the present invention is composed of a disperse dye and an aqueous media.

Specific examples of the disperse dyes used for cyan ink include C.I. Disperse Blue 60, 87, 87:1, 143, 176, 185, and 198. Specific examples of the disperse dyes used for blue ink include C.I. Disperse Blue 56, 73, 79, 79:1, 113, 128, 148, 154, 158, 165, 165:1, 165:2, 183, 197, 201, 214, 224, 225, 257, 266, 267, 287, 358 and 368. The disperse dyes of the present invention, however, are not limited thereto.

The content of the above-described dye (or total content of two kinds or more of dyes) is in the range of from 0.1 to 25 wt %, preferably, in the range of from 0.2 to 20 wt %, more preferably, in the range of from 0.3 to 15 wt %. When it is less than 0.1 wt %, the density of color development may be insufficient; while when it exceeds 25 wt %, the storage stability of ink may be deteriorated, and the discharge of ink tends to be obstructed by the thickening and precipitation of the dye caused by ink evaporation near the tip of an orifice.

As a different form of the present invention, there may be used ink in which the cyan dye and the blue dye are mixed in a ratio of from 10:1 to 100:1, preferably, from 12:1 to 50:1, more preferably, from 15:1 to 50:1.

In this case, the total content of the dyes is in the range of from 0.5 to 20 wt %, preferably, in the range of from 1 to 15 wt %, more preferably, in the range of from 1.5 to 10 wt %.

In the above method of using one kind of ink in which dyes are previously mixed with each other, the distribution of the dyes on a cloth is equalized; however, in terms of the expression obtained by changing the jetting ratio in dots, the method has a limitation as compared with the ink overlapping method, so that the preferred range of the total content of dyes in the single ink is narrowed more than ink used for the overlapping method.

With respect to the expression of cyan and blue in the present invention, the color after dyeing of a cloth with the ink is compared with a standard color chip specified in JIS-Z-8721, and the color classified in BG (Blue Green) is taken as cyan, while the color classified into B (Blue) is taken as blue. The standard color chip specified in JIS-Z-8721 is used for judging an objective color on the basis of the color sample, wherein the hue is classified into ten groups such as BG and B.

As a compound for dispersing a disperse dye in aqueous media of ink used for the present invention, there can be used a dispersant, surface-active agent, or resin. The dispersant or surface-active agent may be of either an anion type or nonionic type. Specific examples of the anion type include a fatty acid salt, alkyl sulfate, alkyl benzene sulfonate, alkyl naphthalene sulfonate, dialkyl sulfosuccinate, alkyl phosphate, naphthalenesulfonic acid formalin condensate, polyoxyethylene alkyl sulfate, and substituted derivatives thereof. Specific examples of the nonionic types include polyoxyethylene alkyl ether, polyoxyethylene alkylphenyl ether, polyoxyethylene fatty acid ester, sorbitan fatty acid ester, polyoxyethylene sorbitan fatty acid ester, polyoxyethylene alkylamine, glycerol fatty acid ester, oxyethylene-oxypropylene block polymer, and substituted derivatives thereof.

Specific examples of the resin dispersants include a block copolymer, random copolymer and graft copolymer composed of two or more of monomers (including at least one hydrophilic monomer) selected from a group consisting of styrene and its derivative; vinylnaphthalene and its derivative; ester of α, β-unsaturated carboxylic acid and aliphatic alcohol; acrylic acid and its derivative; maleic acid and its derivative; itaconic acid and its derivative; fumaric acid and its derivative; vinyl acetate, vinyl alcohol, vinyl pyrrolidone, acrylamide, and their derivatives; and the salts thereof. These resins are preferably of an alkali soluble type soluble in a solution in which a base is dissolved.

The ink of the present invention or used for the present invention mainly contains water in an amount of from 10 to 93 wt % on the basis of the total weight of the ink, preferably, in the range of from 25 to 87 wt %, more preferably, in the range of from 30 to 82 wt %. The present invention can be more effectively achieved using a water-soluble organic solvent. Specific examples of the water-soluble solvents include a monohydric alcohol series such as methanol, ethanol, isopropyl alcohol; a ketone or ketone alcohol series such as acetone and diacetone alcohol; an ether series such as tetrahydrofuran and dioxane; an addition polymer of oxyethylene or oxypropylene such as diethylene glycol, triethyleneglycol, tetraethyleneglycol, dipropylene glycol, tripropylene glycol, polyethylene glycol, polypropylene glycol; an alkylene glycol series in which the alkylene radical contains 2 to 6 pieces of carbon atoms, such as ethylene glycol, propylene glycol, trimethylene glycol, butylene glycol and hexylene glycol; a triol series such as 1,2,6-hexane triol; thiodiglycol; bishydroxyethyl sulfone; glycerol; a lower alkyl ether series of polyhydric alcohol such as ethylene glycol monomethyl (or ethyl) ether, diethylene glycol monomethyl (or ethyl) ether, and triethylene glycol monomethyl (or ethyl) ether; a lower dialkylether series of polyhydric alcohol such as triethylene glycol dimethyl (or ethyl) ether, and tetraethylene glycol dimethyl (or ethyl) ether; sulfolane; N-methyl-2-pyrrolidone, 2-pyrrolidone, and 1,3-dimethyl-2-imidazolidone. The content of the water-soluble organic solvent is generally in the range of from 0 to 50 wt % on the total weight of ink, preferably, in the range of from 2 to 45 wt %.

The above materials may be used singly or as the mixture thereof. The most preferable composition of the liquid media is such that the solvent contains at least one kind of monohydric or polyhydric alcohol and its derivative, preferably, thiodiglycol, bishydroxyethylsulfone, diethylene glycol, triethylene glycol, triethylene glycol monomethylether, tetraethylene glycol dimethyl ether, and ethanol.

The ink of the present invention or used for the present invention mainly contains the above-described components, and it may be added with various dispersants, surface-active agents, viscosity adjusting agents, surface tension adjusting agents, and optical whitening agent, if needed.

Next, the textile-printing method of the present invention using a cyan ink material and a blue ink material will be described.

The feature of the present invention lies in that cyan ink and blue ink respectively containing at least a cyan disperse dye and a blue disperse dye are overlapped on a cloth, and the jetted ratio by weight between the cyan dye and the blue dye at the overlapped portion is in the range of from 10:1 to 100:1, preferably, in the range of from 12:1 to 50:1, more preferably, in the range of from 15:1 to 50:1. When it is less than 100:1, the effect of increasing the density of the hue of cyan cannot be achieved; while when it is more than 10:1, the hue of blue is excessively strengthened, so that the cyan thus obtained is unsuitable for subtractive color mixture, and the saturation in green expression obtained by mixture of the cyan with yellow color is significantly reduced.

The ink jet recording in the present invention can be performed using any type of the conventional ink jet recording methods. However, such a method as disclosed in Unexamined Japanese Patent Publication SHO 54-59936 is most effective, wherein ink applied with a thermal energy is abruptly changed in volume, and is discharged from an orifice by a force generated due to the change in volume. One explanation for this is that, in the case of using a recording head having a plurality of orifices, the above method is advantageous in that a variation in the discharge speed of ink between orifices is small and the discharge speeds of ink can be specified in the range of from 5 to 20 m/sec. The permeation of ink droplets in fibers obtained when ink containing a disperse dye collides with a cloth at such a discharge speed is most preferable. Moreover, in the case of using the ink of the present invention containing the above-described dye in this method, the stable textile-printing can be performed without generation of precipitation of foreign matters on a heater or disconnection even when the recording is continuously performed for a long period of time.

In the present invention, to obtain the effective textile-printing method, it is desirable that a discharged droplet amount is in the range of 20 to 200 pl; an amount of ejected ink is in the range of from 4 to 40 nl/mm$^2$; the drive frequency is in the range of at least 1.5 kHz; and the head temperature is in the range of from 35° to 60°.

One preferred apparatus for textile-printing used in the present invention will be described, wherein a thermal energy corresponding to a recording signal is applied to ink in a chamber of a recording head, to thereby generate ink droplets by the thermal energy.

Figure 2:
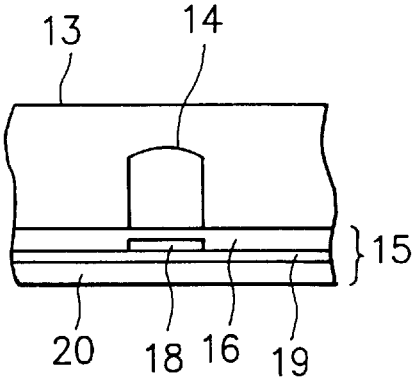
FIG. 2 is a front cross-sectional view of the head portion of the ink jet recording apparatus.
Figure 3:
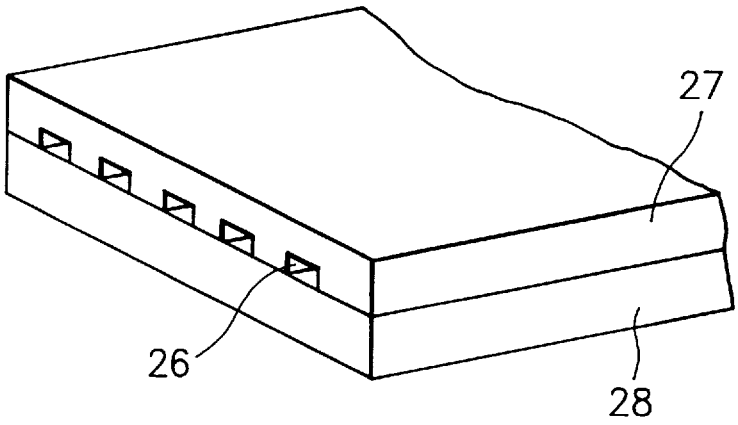
FIG. 3 is a perspective view of a multi-head replaced with the head shown in FIG. 1.

The construction example of a head as an essential portion of the apparatus is shown in FIGS. 1, 2 and 3.

A head 13 includes a plate made of glass, ceramics or plastic having each channel 14 for passing ink therethrough, and a heat-generating assembly 15 used for thermally sensitive recording (an assembly is shown in the drawings, but it is not restrictive) which is bonded to the plate. The heat-generating assembly 15 includes a protective film 16 formed of silicon oxide or the like, aluminum electrodes 17-1, 17-2, a heat-generation resistor layer 18, a thermal storage layer 19, and a substrate 20 excellent in heat radiation for example made of alumina.

Ink 21 reaches each discharge orifice (a fine port) 22, and forms a meniscus 23 by a pressure P.

Now, when an electric signal is applied to the electrodes 17-1 and 17-2, an area <n> of the heat-generating assembly 15 is abruptly heated, and bubbles are generated at the ink 21 which is contacted with the area <n>. A meniscus 23 is caused to protrude outward by a pressure generated due to the generation of the bubbles, and the ink 21 is discharged. The ink 21 flies as a recording droplet 24 from the orifice 22 to a cloth 25 containing fibers capable of being dyed with a disperse dye. FIG. 3 shows the appearance of a multi-head including a plurality of the heads 13 shown in FIG. 1. The multi-head is fabricated by bonding a glass plate 27 having multiple channels 26 with a heat-generating assembly 28 having the same construction as that shown in FIG. 1. In addition, FIG. 1 is a side cross-sectional view of the head 13 along the ink flow passage; and FIG. 2 is a front sectional view taken along line 2—2 of FIG. 1.

Figure 4:
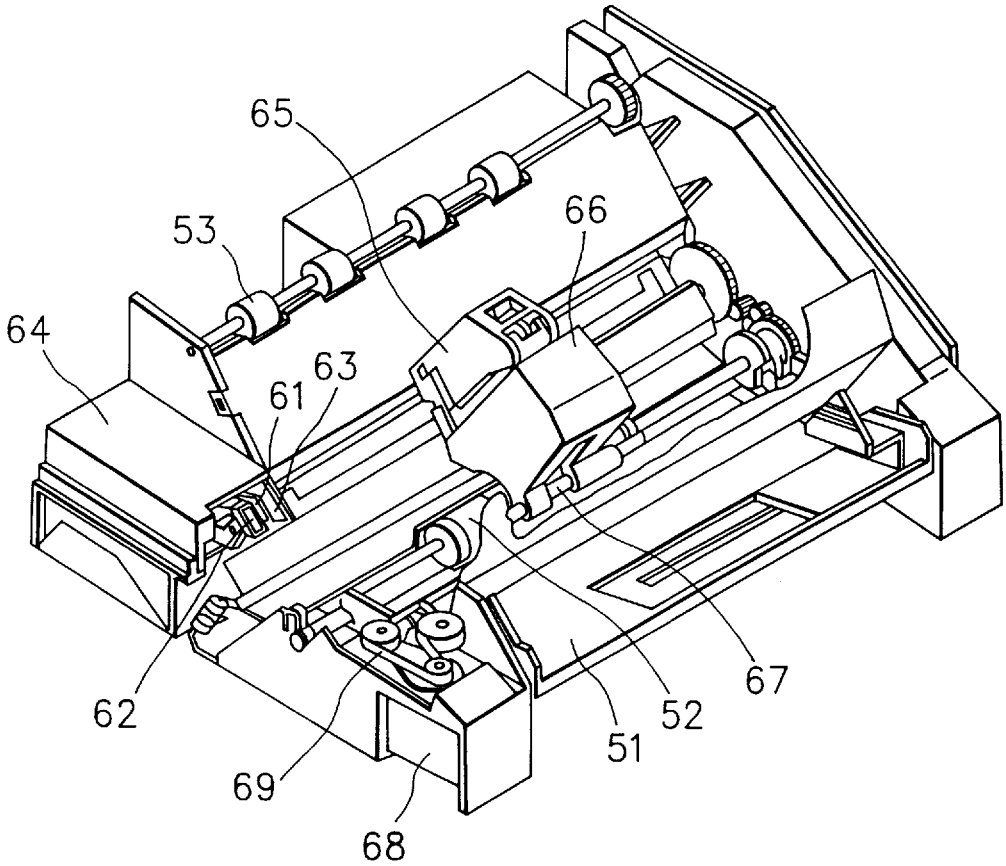
FIG. 4 is a perspective view showing one example of the ink jet recording apparatus.

FIG. 4 shows one example of an ink jet recording apparatus assembled with such a head.

In FIG. 4, reference numeral 61 indicates a blade which serves as a wiping member. The one end of the blade 61 is held by a blade holding member in the form of a cantilever. The blade 61 is disposed at a position adjacent to a recording area recorded by a recording head, and in this embodiment, it is held in the form of projecting into the path of motion of the recording head. Reference numeral 62 indicates a cap disposed at a home position adjacent to the blade 61. The cap 62 can be moved in a direction perpendicular to the direction of motion of the recording head, and abuts a discharge port surface for capping. Reference numeral 63 indicates an absorber provided adjacently to the blade 61, and like the blade 61, it is held in the form of projecting into the path of motion of the recording head. The blade 61, cap 62 and absorber 63 constitute a discharge recover portion 64. The blade 61 and absorber 63 serve to remove moisture and dust from the ink discharge port surface.

Reference numeral 65 indicates a recording head having a discharge energy generating means for discharging ink onto a cloth facing to the discharge port surface disposed with discharge ports; and 66 is a carriage mounting the recording head 65 for moving it. The carriage 66 is slidably engaged to a guide shaft 67, and part of the carriage 66 is connected in a manner not shown to a belt 69 driven by a motor 68. The carriage 66 can be thus moved along the guide shaft 67, that is, it can be moved across the recording area recorded by the head 65 and the adjacent area.

Reference numeral 51 indicates a cloth supply portion for inserting a cloth; and 52 is a cloth supply roller driven by a motor (not shown). With this construction, a cloth is supplied to a position facing to the discharge port surface of the recording head, and is further supplied to a cloth discharge portion having a cloth discharge roller 53 as the recording progresses.

In the above-described construction, when the recording head 65 is returned to the home position after completion of recording, the cap 62 of the head recover portion 64 is retreated from the path of motion of the recording head 65, but the blade 61 is projected into the moving path. As a result, the discharge port surface of the recording head 65 is wiped. In addition, in the case where the capping is intended to be performed by the abutment of the cap 62 on the discharge surface of the recording head 65, the cap 62 is moved so as to project into the path of motion of the recording head 65.

When the recording head 65 is moved to the recording start position from the home position, the cap 62 and the blade 61 are set at the same positions as those upon the above-described wiping. As a result, during this movement, the discharge port surface of the recording head 65 is wiped.

The recording head is moved to the home position not only after the completion of recording and upon discharge recovery but also it is moved to the home position adjacent to the recording area at specified intervals of time during movement in the recording area for recording, and the wiping is performed during this movement.

Figure 5:
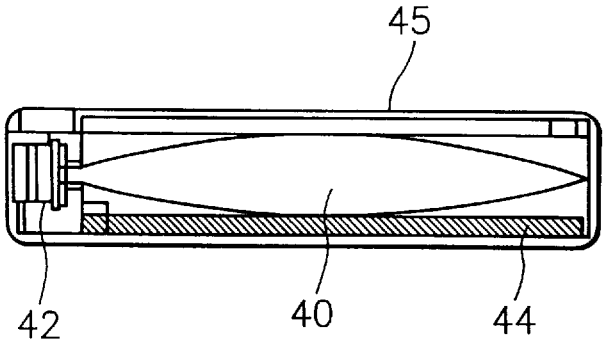
FIG. 5 is a side cross-sectional view of an ink cartridge.

FIG. 5 shows one example of an ink cartridge containing ink supplied to the head through an ink supply member, for example, a tube. Here, reference numeral 40 indicates an ink container, for example and ink bag for containing ink, which is provided at the leading end with a rubber plug 42. The ink in the ink bag 40 can be supplied to the head by insertion of a needle (not shown) in the plug 42. Reference numeral 44 indicates an absorber for receiving waste ink. With respect to the ink container of the present invention, the surface thereof being in contact with ink is preferably formed of polyolefin, particularly, polyethylene. The ink jet recording apparatus used in the present invention is not limited to the above-described type in which the head is separated from the ink cartridge, but may include a type in which they are integrated with each other as shown in FIG. 6.

Figure 6:
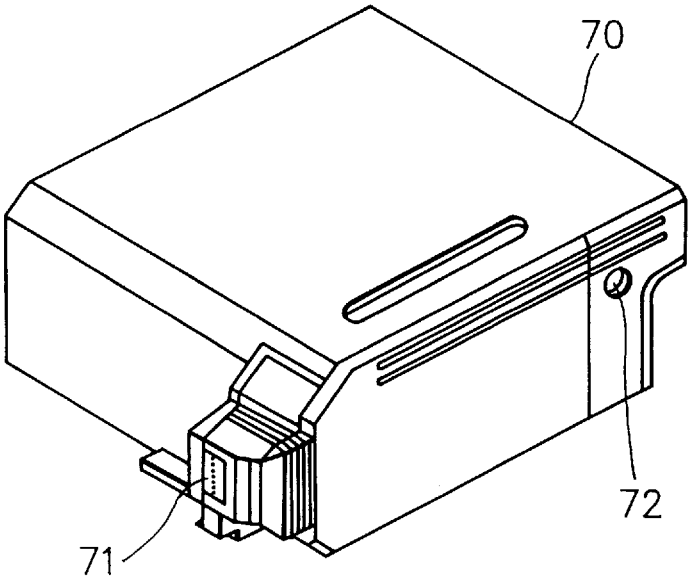
FIG. 6 is a perspective view of a recording unit.

In FIG. 6, reference numeral 70 indicates a recording unit containing an ink container, for example, an ink absorber for containing ink. Ink in the ink absorber is discharged as ink droplets from an head portion 71 having a plurality of orifices. The ink absorber is preferably made of polyurethane. Reference numeral 72 indicates a vent hole allowing the interior of the recording unit 70 to communicate with the atmosphere. The recording unit 70 is used in place of the recording head shown in FIG. 4, and it is removably mounted to the carriage 66.

The ink used in the present invention is thus supplied to a cloth; however, in this state, the ink is only fixed on the cloth. Accordingly, it is then essential to first fix the dyes to fibers by reaction and then remove the non-fixed dyes. With respect to the reacting/fixing process and non-fixed dye removing process, the fixing is effectively achieved using the HT (High Temperature) steaming method or thermosol method. In the case of the HT steaming method, the treatment is preferably performed for a time from 2 to 30 mins at 140° to 180° C. more preferably, for a time from 6 to 8 mins at 160° to 180° C. In the case of thermosol method, the treatment is preferably performed for a time from 10 seconds to 5 minutes at 160° to 210° C. more preferably, for a time from 20 seconds to 2 minutes at 180° to 210° C. The removing method may be made by any of the conventional methods; however it is preferably performed by reduction washing.

The cloth thus treated is cut to a desired size, and the cut-off pieces are subjected to processing for obtaining a final product (processed article), for example, sewing, bonding and fusing, to provide items such as clothes, for example, one-piece suit, dress, necktie and swimsuit; bed cover, sofa cover, handkerchief, and curtain. The methods of sewing cloths into clothes and daily necessities have been variously described in the known documents, for example, in "Current Knit Sewing Manual" (issued by Fiber Journal Sha) and "Souen" (monthly issued by Bunka Shuppan Kyoku).

Next, the present invention will be more fully described with reference to inventive examples and comparative examples. In the following description, the terms "parts" and "%" are the abbreviations of "parts by weight" and "wt %" insofar as the specific proviso is not added.

EXAMPLE 1

Preparation of Cloth (A)

A plain woven fabric as a cloth, formed of polyester yarns, each having an average thickness of 40 denier and being composed of polyester filament fibers each having an average thickness of 2 denier, was previously dipped in an aqueous solution containing urea in a concentration of 10%, after which it was dehydrated at a squeezing ratio of 60% and then dried, to thus adjust the moisture regain of the cloth at 7%.

Preparation of Disperse Dye Solution (I,II)

| | |
|---|---|
| β-naphthalenesulfonic acid formaldehyde condensate | 20 parts |
| ion-exchanged water | 55 parts |
| diethylene glycol | 10 parts |

The above components were mixed, and newly added with 15 parts of each of the following disperse dyes. The resultant sample was pre-mixed for 30 mins, and subjected to a disperse treatment in the following condition.

Disperse Dye

C.I. Disperse Blue 60 (for Disperse Dye I)

C.I. Disperse Blue 183 (for Disperse Dye II)

Disperse Treatment Condition

| | |
|---|---|
| Dispersing Machine | Sand Grinder (produced by Igarashi Kikai) |
| Grinding Medium | Zirconium Beads (diameter: 1 mm) |
| Packing of Grinding Medium | 50% (by volume) |
| Rotational Frequency | 1500 rpm |
| Grinding Time | 3 hrs |

The dispersed solution was then filtered using a Fluoro Pore Filter-FP-250, (tradename, produced by Sumitomo Electric), to remove coarse particles, thus obtaining a disperse dye solution (I,II).

Fabrication of Ink (a)

| | |
|---|---|
| Disperse Dye Solution (I) | 40 parts |
| Thiodiglycol | 24 parts |
| Diethylene Glycol | 11 parts |
| Sodium Metasilicate | 0.0005 parts |
| Iron Sulfate | 0.001 parts |
| Nickel Chloride | 0.0003 parts |
| Zinc Sulfate | 0.0003 parts |
| Calcium Chloride | 0.002 parts |
| Ion-Exchanged Water | 25 parts |

The above components were mixed, and the mixed solution was adjusted in its hydrogen ion concentration at pH 8 by addition of sodium hydroxide. It was agitated for two hours, and was filtered using a Fluoro Pore Filter-FP-100 (tradename, produced by Sumitomo Electric), thus obtaining ink (a).

Fabrication of Ink (b)

| | |
|---|---|
| Disperse Dye Solution (II) | 30 parts |
| Thiodiglycol | 15 parts |
| Diethylene Glycol | 10 parts |
| Tetraethylene Glycol Dimethylether | 5 parts |
| Sodium Metasilicate | 0.0005 parts |
| Iron Sulfate | 0.001 parts |
| Nickel Chloride | 0.0003 parts |
| Zinc Sulfate | 0.0003 parts |
| Calcium Chloride | 0.002 parts |
| Ion-Exchanged Water | 40 parts |

The above components were mixed, and the mixed solution was adjusted in its hydrogen ion concentration at pH 8 by addition of sodium hydroxide. It was agitated for two hours, and was filtered using a Fluoro Pore Filter-FP-100 (tradename, produced by Sumitomo Electric), thus obtaining ink (b).

The inks (a, b) thus obtained were loaded into a Color Bubble Jet Printer BJC600 (tradename, produced by Canon), and a sample for mixing each ink of two colors was printed on the above-described cloth (A) while a printing density of each ink and an ink jetting order were adjusted as shown in Table 1, and then fixed by HT steaming treatment for 8 mins at 180° C. After that, the cloth was subjected to water-washing and reduction-washing. The sample thus obtained was evaluated in terms of hue, density and color development stability. The results are shown in Table 1. As can be seen in Table 1, the color development stability was excellent irrespective of the ink jetting order, and a dense color of cyan was obtained.

EXAMPLE 2

Preparation of Disperse Dye Solution (III, IV)

| | |
|---|---|
| sodium lignin sulfonate | 15 parts |
| ion-exchanged water | 55 parts |
| diethylene glycol | 15 parts |

The above components were mixed, and newly added with 15 parts of each of the following disperse dyes. The resultant sample was pre-mixed for 30 mins, and subjected to a disperse treatment in the following condition.

Disperse Dye

C.I. Disperse Blue 87 (for Disperse Dye III)

C.I. Disperse Blue 214 (for Disperse Dye IV)

Disperse Treatment Condition

| | |
|---|---|
| Dispersing Machine | Sand Grinder (produced by Igarashi Kikai) |
| Grinding Medium | Glass Beads (diameter: 0.5 mm) |
| Packing of Grinding Medium | 70% (by volume) |
| Rotational Frequency | 1500 rpm |
| Grinding Time | 3 hrs |

The dispersed solution was then filtered using a Fluoro Pore Filter-FP-250, (tradename, produced by Sumitomo Electric), to remove coarse particles, thus obtaining a disperse dye solution (III,IV).

Fabrication of Ink (c)

| | |
|---|---|
| Disperse Dye Solution (III) | 30 parts |
| Thiodiglycol | 19 parts |
| Diethylene Glycol | 11 parts |
| Isopropyl Alcohol | 5 parts |
| Sodium Metasilicate | 0.0005 parts |
| Iron Sulfate | 0.001 parts |
| Nickel Chloride | 0.0003 parts |
| Zinc Sulfate | 0.0003 parts |
| Calcium Chloride | 0.002 parts |
| Ion-Exchanged Water | 35 parts |

The above components were mixed, and the mixed solution was adjusted in its hydrogen ion concentration at pH 8 by addition of sodium hydroxide. It was agitated for two hours, and was filtered using a Fluoro Pore Filter-FP-100 (tradename, produced by Sumitomo Electric), thus obtaining ink (c).

Fabrication of Ink (d)

| | |
|---|---|
| Disperse Dye Solution (IV) | 30 parts |
| Thiodiglycol | 15 parts |
| Diethylene Glycol | 10 parts |
| Triethylene Glycol | 5 parts |
| Sodium Metasilicate | 0.0005 parts |
| Iron Sulfate | 0.001 parts |
| Nickel Chloride | 0.0003 parts |
| Zinc Sulfate | 0.0003 parts |
| Calcium Chloride | 0.002 parts |
| Ion-Exchanged Water | 40 parts |

The above components were mixed, and the mixed solution was adjusted in its hydrogen ion concentration at pH 8 by addition of sodium hydroxide. It was agitated for two hours, and was filtered using a Fluoro Pore Filter-FP-100 (tradename, produced by Sumitomo Electric), thus obtaining ink (d).

Using the inks (c, d) thus obtained, the printing was performed on the cloth (A) used in Example 1 in the same manner as in Example 1, and then fixed by HT steaming treatment for 8 mins at 180° C. After that, the cloth was subjected to water-washing and reduction-washing. The sample thus obtained was evaluated in terms of hue, density and color development stability. The results are shown in Table 1. As can be seen in Table 1, the color development stability was excellent irrespective of the ink jetting order, and a dense color of cyan was obtained.

EXAMPLE 3

Preparation of Cloth (B)

A plain woven fabric as a cloth, formed of polyester yarns, each having an average thickness of 70 denier and being composed of polyester filament fibers each having an average thickness of 0.7 denier, was previously dipped in an aqueous solution containing carboxymethylcellulose in a concentration of 1%, after which it was dehydrated at a squeezing ratio of 60% and then dried, to thus adjust the moisture regain of the cloth at 10%.

Preparation of Disperse Dye Solution (V,VI)

| | |
|---|---|
| sodium polyoxyethylene alkylether sulfate | 5 parts |
| β-naphthalenesulfonic acid formaldehyde condensate | 10 parts |
| ion-exchanged water | 55 parts |
| ethylene glycol | 20 parts |

The above components were mixed, and newly added with 10 parts of each of the following disperse dyes. The resultant sample was pre-mixed for 30 mins, and subjected to a disperse treatment in the following condition.

Disperse Dye

C.I. Disperse Blue 185 (for Disperse Dye V)

C.I. Disperse Blue 165 (for Disperse Dye VI)

Disperse Treatment Condition

| | |
|---|---|
| Dispersing Machine | Sand Grinder (produced by Igarashi Kikai) |
| Grinding Medium | Glass Beads (diameter: 1 mm) |
| Packing of Grinding Medium | 50% (by volume) |
| Rotational Frequency | 1500 rpm |
| Grinding Time | 3 hrs |

The dispersed solution was then filtered using a Fluoro Pore Filter-FP-250, (tradename, produced by Sumitomo Electric), to remove coarse particles, thus obtaining a disperse dye solution (V,VI).

Fabrication of Ink (e)

| | |
|---|---|
| Disperse Dye Solution (IV) | 30 parts |
| Thiodiglycol | 24 parts |
| Diethylene Glycol | 11 parts |
| Sodium Metasilicate | 0.0005 parts |
| Iron Sulfate | 0.001 parts |
| Nickel Chloride | 0.0003 parts |
| Zinc Sulfate | 0.0003 parts |
| Calcium Chloride | 0.002 parts |
| Ion-Exchanged Water | 35 parts |

The above components were mixed, and the mixed solution was adjusted in its hydrogen ion concentration at pH 8 by addition of sodium hydroxide. It was agitated for two hours, and was filtered using a Fluoro Pore Filter-FP-100 (tradename, produced by Sumitomo Electric), thus obtaining ink (e).

Fabrication of Ink (f)

| | |
|---|---|
| Disperse Dye Solution (VI) | 35 parts |
| Thiodiglycol | 20 parts |
| Diethylene Glycol | 10 parts |
| Sodium Metasilicate | 0.0005 parts |
| Iron Sulfate | 0.001 parts |
| Nickel Chloride | 0.0003 parts |
| Zinc Sulfate | 0.0003 parts |
| Calcium Chloride | 0.002 parts |
| Ion-Exchanged Water | 35 parts |

The above components were mixed, and the mixed solution was adjusted in its hydrogen ion concentration at pH 8 by addition of sodium hydroxide. It was agitated for two hours, and was filtered using a Fluoro Pore Filter-FP-100 (tradename, produced by Sumitomo Electric), thus obtaining ink (f).

Using the inks (e, f) thus obtained, the printing was performed on the above-described cloth (B) in the same manner as in Example 3, and then fixed by HT steaming treatment for 8 mins at 180° C. After that, the cloth was subjected to water-washing and reduction-washing. The sample thus obtained was evaluated in terms of hue, density and color development stability. The results are shown in Table 1. As can be seen in Table 1, the color development stability was excellent irrespective of the ink jetting order, and a dense color of cyan was obtained.

EXAMPLE 4

Preparation of Disperse Dye Solution (VII, VIII)

| | |
|---|---|
| sodium polyoxyethylene alkylether sulfate | 5 parts |
| β-naphthalenesulfonic acid formaldehyde condensate | 10 parts |
| ion-exchanged water | 55 parts |
| ethylene glycol | 20 parts |

The above components were mixed, and newly added with 10 parts of each of the following disperse dyes. The resultant sample was pre-mixed for 30 mins, and subjected to a disperse treatment in the following condition.

Disperse Dye

C.I. Disperse Blue 143 (for Disperse Dye VII)

C.I. Disperse Blue 79 (for Disperse Dye VIII)

Disperse Treatment Condition

| | |
|---|---|
| Dispersing Machine | Sand Grinder (produced by Igarashi Kikai) |
| Grinding Medium | Glass Beads (diameter: 1 mm) |
| Packing of Grinding Medium | 50% (by volume) |
| Rotational Frequency | 1500 rpm |
| Grinding Time | 3 hrs |

The dispersed solution was then filtered using a Fluoro Pore Filter-FP-250, (tradename, produced by Sumitomo Electric), to remove coarse particles, thus obtaining a disperse dye solution (VII, VIII).

Fabrication of Ink (g)

| | |
|---|---|
| Disperse Dye Solution (VII) | 30 parts |
| Thiodiglycol | 24 parts |
| Diethylene Glycol | 11 parts |
| Sodium Metasilicate | 0.0005 parts |
| Iron Sulfate | 0.001 parts |
| Nickel Chloride | 0.0003 parts |
| Zinc Sulfate | 0.0003 parts |
| Calcium Chloride | 0.002 parts |
| Ion-Exchanged Water | 35 parts |

The above components were mixed, and the mixed solution was adjusted in its hydrogen ion concentration at pH 8 by addition of sodium hydroxide. It was agitated for two hours, and was filtered using a Fluoro Pore Filter-FP-100 (tradename, produced by Sumitomo Electric), thus obtaining ink (g).

Fabrication of Ink (h)

| | |
|---|---|
| Disperse Dye Solution (VIII) | 35 parts |
| Thiodiglycol | 20 parts |
| Diethylene Glycol | 10 parts |
| Sodium Metasilicate | 0.0005 parts |
| Iron Sulfate | 0.001 parts |
| Nickel Chloride | 0.0003 parts |
| Zinc Sulfate | 0.0003 parts |
| Calcium Chloride | 0.002 parts |
| Ion-Exchanged Water | 35 parts |

The above components were mixed, and the mixed solution was adjusted in its hydrogen ion concentration at pH 8 by addition of sodium hydroxide. It was agitated for two hours, and was filtered using a Fluoro Pore Filter-FP-100 (tradename, produced by Sumitomo Electric), thus obtaining ink (h).

Using the ink (g, h) thus obtained, the printing was performed on the cloth (B) used in Example 3 in the same manner as in Example 3, and then fixed by thermosol treatment for 40 seconds at 200° C. After that, the cloth was subjected to water-washing and reduction-washing. The sample thus obtained was evaluated in terms of hue, density and color development stability. The results are shown in Table 1. As can be seen in Table 1, the color development stability was excellent irrespective of the ink jetting order, and a dense color of cyan was obtained.

Comparative Example 1

Using the inks (a, b) used in Example 1, the printing was performed on the cloth (A) used in Example 1 in the same manner as in Example 1 under the condition shown in Table 1, and then fixed by HT steaming for 8 mins at 180° C. After that, the cloth was subjected to water-washing and reduction-washing. The sample thus obtained was evaluated in terms of hue, density and color development stability. The results are shown in Table 1. As can ben seen in Table 1, the color development stability and the hue were deteriorated and the density was also lowered as compared with Example 1.

Comparative Example 2

Using the inks (c, d) used in Example 2, the printing was performed on the cloth (A) used in Example 2 in the same manner as in Example 2 under the condition shown in Table 1, and then fixed by HT steaming for 8 mins at 180° C. After that, the cloth was subjected to water-washing and reduction-washing. The sample thus obtained was evaluated in terms of hue, density and color development stability. The results are shown in Table 1. As can ben seen in Table 1, the color development stability and the hue were deteriorated and the density was also lowered as compared with Example 1.

EXAMPLE 5

Fabrication of Ink (i)

| | |
|---|---|
| Disperse Dye Solution (I) | 38 parts |
| Disperse Dye Solution (II) | 2 parts |
| Thiodiglycol | 24 parts |
| Diethylene Glycol | 11 parts |
| Sodium Metasilicate | 0.0005 parts |
| Iron Sulfate | 0.001 parts |
| Nickel Chloride | 0.0003 parts |
| Zinc Sulfate | 0.0003 parts |
| Calcium Chloride | 0.002 parts |
| Ion-Exchanged Water | 25 parts |

The above components were mixed, and the mixed solution was adjusted in its hydrogen ion concentration at pH 8 by addition of sodium hydroxide. It was agitated for two hours, and was filtered using a Fluoro Pore Filter-FP-100 (tradename, produced by Sumitomo Electric), thus obtaining ink (i).

The ink jet textile-printing ink (i) thus obtained was loaded into a Color Bubble Jet Printer BJC600 (tradename, produced by Canon), and a sample was printed on the cloth (A) used in Example 1 at each printing density of 100% and 200%, and then fixed by HT steaming treatment for 8 mins at 180° C. After that, the cloth was subjected to water-washing and reduction-washing. The sample thus obtained was evaluated in terms of hue, density and color development stability. The results are shown in Table 2. As can be seen in Table 2, a dense color of cyan was obtained.

EXAMPLE 6

Fabrication of Ink (j)

An ink jet textile-printing ink (j) of the present invention was obtained in the same manner as in Example 5, except that the contents of the disperse dye solutions (I) and (II) were specified at 39.2 parts and 0.8 parts, respectively.

Using the ink (j) thus obtained, the printing was performed on the cloth (A) used in Example 1 in the same manner as in Example 5, and then fixed by HT steaming treatment for 8 mins at 180° C. After that, the cloth was subjected to water-washing and reduction-washing. The sample thus obtained was evaluated in terms of hue, density and color development stability. The results are shown in Table 2. As can ben seen in Table 2, a dense color of cyan was obtained.

EXAMPLE 7

Fabrication of Ink (k)

An ink jet textile-printing ink (k) of the present invention was obtained in the same manner as in Example 5, except that the contents of the disperse dye solutions (I) and (II) were specified at 37.5 parts and 2.5 parts, respectively.

Using the ink (k) thus obtained, the printing was performed on the cloth (A) used in Example 1 in the same manner as in Example 5, and then fixed by HT steaming treatment for 8 mins at 180° C. After that, the cloth was subjected to water-washing and reduction-washing. The sample thus obtained was evaluated in terms of hue, density and color development stability. The results are shown in Table 2. As can be seen in Table 2, a dense color of cyan was obtained.

EXAMPLE 8

Fabrication of Ink (l)

| | |
|---|---|
| Disperse Dye Solution (V) | 38.4 parts |
| Disperse Dye Solution (VI) | 1.6 parts |
| Thiodiglycol | 15 parts |
| Diethylene Glycol | 10 parts |
| Tetraethylene Glycol Dimethylether | 7 parts |
| Sodium Metasilicate | 0.0005 parts |
| Iron Sulfate | 0.001 parts |
| Nickel Chloride | 0.0003 parts |
| Zinc Sulfate | 0.0003 parts |
| Calcium Chloride | 0.002 parts |
| Ion-Exchanged Water | 28 parts |

The above components were mixed, and the mixed solution was adjusted in its hydrogen ion concentration at pH 8 by addition of sodium hydroxide. It was agitated for two hours, and was filtered using a Fluoro Pore Filter-FP-100 (tradename, produced by Sumitomo Electric), thus obtaining an ink jet textile-printing ink (l).

Using ink jet textile-printing ink (l) thus obtained, the printing was performed on the cloth (B) used in Example 3 in the same manner as in Example 5, and then fixed by HT steaming treatment for 8 mins at 180° C. After that, the cloth was subjected to water-washing and reduction-washing. The sample thus obtained was evaluated in terms of hue, density and color development stability. The results are shown in Table 2. As can be seen in Table 2, a dense color of cyan was obtained.

EXAMPLE 9

Fabrication of Ink (m)

| | |
|---|---|
| Disperse Dye Solution (VII) | 38.7 parts |
| Disperse Dye Solution (VIII) | 1.3 parts |
| Thiodiglycol | 20 parts |
| Diethylene Glycol | 6 parts |
| Isopropyl Alcohol | 4 parts |
| Sodium Metasilicate | 0.0005 parts |
| Iron Sulfate | 0.001 parts |
| Nickel Chloride | 0.0003 parts |
| Zinc Sulfate | 0.0003 parts |
| Calcium Chloride | 0.002 parts |
| Ion-Exahanged Water | 30 parts |

The above components were mixed, and the mixed solution was adjusted in its hydrogen ion concentration at pH 8 by addition of sodium hydroxide. It was agitated for two hours, and was filtered using a Fluoro Pore Filter-FP-100 (tradename, produced by Sumitomo Electric), thus obtaining an ink jet textile-printing ink (m).

Using ink jet textile-printing ink (m) thus obtained, the printing was performed on the cloth (B) used in Example 3 in the same manner as in Example 5, and then fixed by thermosol treatment for 40 seconds at 200° C. After that, the cloth was subjected to water-washing and reduction-washing. The sample thus obtained was evaluated in terms of hue, density and color development stability. The results are shown in Table 2. As can be seen in Table 2, a dense color of cyan was obtained.

Comparative Example 3

Fabrication of Ink (n)

An ink jet textile-printing ink (n) of the present invention was obtained in the same manner as in Example 5, except that the contents of the disperse dye solutions (I) and (II) were specified at 36 parts and 4 parts, respectively.

Using the ink (n) thus obtained, the printing was performed on the cloth (A) used in Example 1 in the same manner as in Example 5, and then fixed by HT steaming treatment for 8 mins at 180° C. After that, the cloth was subjected to water-washing and reduction-washing. The sample thus obtained was evaluated in terms of hue, density and color development stability. The results are shown in Table 2. As can be seen in Table 2, the hue was shifted to the blue area as compared with Examples 5 to 7.

Comparative Example 4

Fabrication of Ink (o)

An ink jet textile-printing ink (o) of the present invention was obtained in the same manner as in Example 5, except that the contents of the disperse dye solutions (I) and (II) were specified at 39.63 parts and 0.37 parts, respectively.

Using the ink (o) thus obtained, the printing was performed on the cloth (A) used in Example 1 in the same manner as in Example 5, and then fixed by HT steaming treatment for 8 mins at 180° C. After that, the cloth was subjected to water-washing and reduction-washing. The sample thus obtained was evaluated in terms of hue, density and color development stability. The results are shown in Table 2. As can be seen in Table 2, the density was lowered as compared with Examples 5 to 7.

As described above, according to the textile-printing method of the present invention, there can be obtained a highly dense and clear textile-printed matter, and also can be obtained a stable image without a change in hue even when the ink jetting order is somewhat varied.

TABLE 1

| | | total jetted amount of dye (ng/cm$^2$) | jetted ratio by weight between dyes cyan:blue | hue*1 | density*2 | color development stability*3 |
|---|---|---|---|---|---|---|
| Example 1 | ① | 50 | 15:1 | BG | 1.45 | A |
| | ② | 50 | 22:1 | BG | 1.38 | A |
| | ③ | 50 | 50:1 | BG | 1.32 | A |
| Example 2 | ① | 30 | 15:1 | BG | 1.39 | A |
| | ② | 55 | 22:1 | BG | 1.36 | A |
| | ③ | 80 | 50:1 | BG | 1.36 | A |
| Example 3 | ① | 50 | 15:1 | BG | 1.56 | A |
| | ② | 44 | 20:1 | BG | 1.43 | A |
| | ③ | 35 | 50:1 | BG | 1.31 | A |
| Example 4 | ① | 50 | 16:1 | BG | 1.46 | A |
| | ② | 70 | 25:1 | BG | 1.45 | A |
| | ③ | 100 | 45:1 | BG | 1.45 | A |
| Comparative Example 1 | ① | 50 | 9:1 | B | 1.48 | C |
| | ② | 50 | 105:1 | BG | 1.19 | D |
| | ③ | 50 | 1:0 | BG | 1.10 | not evaluated |
| Comparative Example 2 | ① | 30 | 9:1 | B | 1.41 | C |
| | ② | 80 | 110:1 | BG | 1.22 | B |
| | ③ | 80 | 1:0 | BG | 1.15 | not evaluated |

*1: Each printing batch is compared with a standard color chip in accordance with JIS-Z-8721, and the hue is judged on the basis of the fact that the color is classified in BG (Blue Green) or B (Blue).
Note 1: The standard color chip system in accordance with JIS-Z-8721 is used for judging an objective color on the basis of color samples, wherein the hue is classified in ten classes containing BG (Blue Green), B (Blue) and the like. In this classifying method, colors in an area from cyan to blue are contained in BG and B.
*2: The optical density (O. D. value) of each printing batch was measured using a Macbeth reflection density ineter RD-918.
*3: The optical density (O. D. value) of each color batch obtained by changing the ink jetting order (cyan blue, blue cyan) was measured using the Macbeth reflection density meter RD-918, and the color development stability was judged on the basis of a difference therebetween.
A: a difference in 0. D. value, being 0.02 or less (a difference due to ink jetting order is small)
B: a difference in 0. D. value, being in the range of from 0.02 to 0.05 (a difference due to ink jetting order is slightly present)
C: a difference in 0. D. value, being 0.05 or more (a difference due to ink jetting order is large)

TABLE 2

| | jetted ratio by weight between dyes in ink cyan dye : blue dye | hue*4 | density*5 |
|---|---|---|---|
| Example 5 | 19:1 | A | 1.36 |
| Example 6 | 49:1 | A | 1.31 |
| Example 7 | 15:1 | A | 1.39 |
| Example 8 | 24:1 | A | 1.38 |
| Example 9 | 30:1 | A | 1.33 |
| Comparative Example 3 | 9:1 | C | 1.42 |
| Comparative Example 4 | 107:1 | A | 1.15 |

*4: Each printing batch is compared with a standard coldr chip in accordance with JIS-Z-8721, and the hue is judged dn the basis of the fact that the color is classified in BG (Blue Green) or B (Blue).
A: portions of 100% and 200% (printing density), being both classified in BG (Blue Green)
B: portions of 100% and 200%, being classified in BG (Blue Green) and B (B1ue), respectively
C: portions of 100% and 200%, being both classified in B (Blue)
Note 1: The standard color chip system in accordance with JIS-Z-8721 is used for judging an objective color on the basis of color sampes, wherein the hue is classified in ten classes containing BG (Blue Green), B (Blue) and the like. In this classifying method, colors in an area frorn cyan to blue are contained in BG and B.
*5: The optical density (O. D. value) of each 100% printing batch was measured using a Macbeth reflection density meter RD-918.

We claim:

1. A textile-printing method of printing on a cloth containing fibers by an ink jet printing system using a cyan ink and a blue ink respectively containing at least disperse dyes of cyan and blue, comprising the steps of:

(a) imparting said cyan ink and said blue ink on said cloth so that said cyan ink and said blue ink are at least partially overlapped to form a cyan color;

(b) heat-treating said cloth imparted with said cyan ink and said blue ink; and (c) washing said heat-treated cloth, wherein said cyan dye is selected from the group consisting of C.I. Disperse Blue 60, C.I. Disperse Blue 87, C.I. Disperse Blue 143, and C.I. Disperse Blue 185, said blue dye is selected from the group consisting of C.I. Disperse Blue 79, C.I. Disperse Blue 165, C.I. Disperse Blue 183, and C.I. Disperse Blue 214, and a weight ratio of said cyan dye to said blue dye at said overlapped portion is in the range of from 10:1 to 100:1.

2. A textile-printing method according to claim 1, further comprising the step of imparting a yellow ink on said cloth to form a green color.

3. A textile-printing method according to claim 1, wherein said heat-treatment is performed by a high temperature steaming method or a thermosol method.

4. The textile-printing method according to claim 1, wherein said ink jet printing system is of a type that discharges ink using thermal energy.

5. A textile-printing method according to claim 1, wherein said cloth contains at least one kind of material selected from a group consisting of a water-soluble metal salt, a water-soluble polymer, urea, thiourea and a surface-active agent in an amount of from 0.01 to 20 wt % on the basis of the total dry weight of said cloth.

6. A printed textile printed using the method according to claim 1.

7. A processed article obtained by processing said printed textile according to claim 6.

8. A processed article obtained by processing at least one piece obtained by cutting a printed textile according to claim 6 to a predetermined size.

9. A processed article according to claim 8, wherein said processing comprises sewing.

10. A textile printing method according to claim 1, wherein said cyan dye is contained in an amount in the range of from 0.1 to 25% by weight of said cyan ink.

11. A textile-printing method according to claim 1, wherein said blue dye is contained in an amount in the range of from 0.1 to 25% by weight of said blue ink.

12. A textile-printing method according to claim 1, wherein the weight ratio of the cyan dye to the blue dye is in the range of from 12:1 to 50:1.

13. A textile-printing method according to claim 1, wherein the weight ratio of the cyan dye to the blue dye is in the range of from 15:1 to 50:1.

14. An aqueous ink for ink jet textile-printing comprising at least disperse dyes of cyan and blue colors and aqueous media, wherein said cyan dye is selected from the group consisting of C.I. Disperse Blue 60, C.I. Disperse Blue 87, C.I. Disperse Blue 143, and C.I. Disperse Blue 185, said blue dye is selected from the group consisting of C.I. Disperse Blue 79, C.I. Disperse Blue 165, C.I. Disperse Blue 183, and C.I. Disperse Blue 214, a weight ratio of said cyan dye to said blue dye is in the range of from 10:1 to 100:1, and said two dyes are contained in the range of from 0.05 to 20% by weight of the ink.

15. An aqueous ink according to claim 14, wherein the aqueous media contains water in an amount in the range of from 10 to 93% by weight of the ink.

16. An aqueous ink according to claim 14, wherein the weight ratio of the cyan dye to the blue dye is in the range of from 12:1 to 50:1.

17. An aqueous ink according to claim 14, wherein the weight ratio of the cyan dye to the blue dye is in the range of from 15:1 to 50:1.

18. An aqueous ink according to claim 14, wherein the total amount of the two dyes contained is in the range of from 1 to 15% by weight of the ink.

19. An aqueous ink according to claim 14, wherein the total amount of the two dyes contained is in the range of from 1.5 to 10% by weight of the ink.

20. A printed textile in which a cyan dye and a blue dye are at least partially overlapped, said cyan dye is selected from the group consisting of C.I. Disperse Blue 60, C.I. Disperse Blue 87, C.I. Disperse Blue 143; and C.I. Disperse Blue 185, said blue dye is selected from the group consisting of C.I. Disperse Blue 79, C.I. Disperse Blue 165, C.I. Disperse Blue 183, and C.I. Disperse Blue 214, and a weight ratio of said cyan dye to said blue dye contained in said overlapped portion is in the range of from 10:1 to 100:1.

21. A printed textile according to claim 20, wherein the weight ratio of said cyan dye to said blue dye is in the range of from 12:1 to 50:1.

22. A printed textile according to claim 20, wherein the weight ratio of said cyan dye to said blue dye is in the range of from 15:1 to 50:1.

23. A textile-printing method of printing on a cloth containing fibers by an ink jet printing system, comprising the steps of:

(a) discharging a cyan ink containing a cyan disperse dye and a blue ink containing a blue disperse dye, respectively, each in the form of a droplet toward said cloth so that said cyan ink and said blue ink are at least partially overlapped to form a cyan color;

(b) heat-treating said cloth deposited with droplets of said cyan ink and said blue ink; and (c) washing said heat-treated cloth, wherein a weight ratio of said cyan ink to said blue ink at said overlapped portion is in the range of 10:1 to 100:1.

24. A textile-printing method according to claim 23, wherein the cyan ink contains at least one kind of dye selected from the group consisting of C.I. Disperse Blue 60, C.I. Disperse Blue 87, C.I. Disperse Blue 87:1, C.I. Disperse Blue 143, C.I. Disperse Blue 176, C.I. Disperse Blue 185, and C.I. Disperse Blue 198; and the blue ink contains at least one kind of dye selected from the group consisting of C.I. Disperse Blue 56, C.I. Disperse Blue 73, C.I. Disperse Blue 79, C.I. Disperse Blue 79:1, C.I. Disperse Blue 113, C.I. Disperse Blue 128, C.I. Disperse Blue 148, C.I. Disperse Blue 154, C.I. Disperse Blue 158, C.I. Disperse Blue 165, C.I. Disperse Blue 165:1, C.I. Disperse Blue 165:2, C.I. Disperse Blue 183, C.I. Disperse Blue 197, C.I. Disperse Blue 201, C.I. Disperse Blue 214, C.I. Disperse Blue 224, C.I. Disperse Blue 225, C.I. Disperse Blue 257, C.I. Disperse Blue 266, C.I. Disperse Blue 267, C.I. Disperse Blue 287, C.I. Disperse Blue 358 and C.I. Disperse Blue 368.

25. A textile-printing method according to claim 23, wherein the heat-treatment is performed by a high temperature steaming method or a thermosol method.

26. A textile-printing method according to claim 23, wherein the ink jet printing system is based on an ink jet system of discharging ink using thermal energy.

27. A textile-printing method according to claim 23, wherein the cloth contains one or more materials selected from the group consisting of a water-soluble metal salt, a water-soluble polymer, urea, thiourea, and a surface-active agent, in an amount of from 0.01 to 20 wt. % on the basis of the total dry weight of the cloth.

* * * * *

UNITED STATES PATENT AND TRADEMARK OFFICE

CERTIFICATE OF CORRECTION

PATENT NO. : 5,888,253 Page 1 of 2

DATED : March 30, 1999

INVENTOR(S) : YAMAMOTO ET AL.

It is certified that error appears in the above-indentified patent and that said Letters Patent is hereby corrected as shown below:

COLUMN 1:

Line 20, "do" should read --does--.

Line 52, "and" should read --and in--.

COLUMN 6:

Line 9, "pieces of" should be deleted.

COLUMN 9:

Line 5, "180° C." should read --180° C.,--.

Line 8, "210° C." should read --210° C.,--.

COLUMN 14:

Line 24, "ben" should read --be--.

Line 37, "ben" should read --be--.

COLUMN 15:

Line 19, "ben" should read --be--.

COLUMN 17:

Table 1, in Comparative Example 1, 2 "D" should read --B--.

UNITED STATES PATENT AND TRADEMARK OFFICE

CERTIFICATE OF CORRECTION

PATENT NO. : 5,888,253 Page 2 of 2

DATED : March 30, 1999

INVENTOR(S) : YAMAMOTO ET AL.

It is certified that error appears in the above-indentified patent and that said Letters Patent is hereby corrected as shown below:

Table 1, Note 3, "(cyan blue, blue cyan)" should read --(cyan → blue, blue → cyan)--.

Signed and Sealed this

Eleventh Day of January, 2000

*Attest:*

Q. TODD DICKINSON

*Attesting Officer*

*Acting Commissioner of Patents and Trademarks*